US006756951B1

(12) United States Patent
Ishizuka et al.

(10) Patent No.: US 6,756,951 B1
(45) Date of Patent: Jun. 29, 2004

(54) DISPLAY APPARATUS AND DRIVING CIRCUIT OF DISPLAY PANEL

(75) Inventors: Shinichi Ishizuka, Tsurugashima (JP); Masami Tsuchida, Tsurugashima (JP); Tsuyoshi Sakamoto, Tsurugashima (JP); Hideo Ochi, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/615,592

(22) Filed: Jul. 13, 2000

(30) Foreign Application Priority Data

Aug. 3, 1999 (JP) ..... 11-219782

(51) Int. Cl.[7] ..... G09G 3/20

(52) U.S. Cl. ..... 345/82; 345/76; 345/84; 345/85; 345/90; 345/92; 315/169.1; 315/169.3; 315/175; 349/39; 349/42

(58) Field of Search ..... 345/82, 84, 85, 345/90, 92, 76; 315/169.1, 169.3, 175; 349/39, 42

(56) References Cited

U.S. PATENT DOCUMENTS 5,311,169 A * 5/1994 Inada et al. ..... 340/781
5,461,430 A * 10/1995 Hagerman ..... 348/674
5,699,085 A * 12/1997 Takei et al. ..... 345/531
5,710,589 A * 1/1998 Genovese ..... 347/262
5,856,812 A * 1/1999 Hush et al. ..... 345/74.1
6,014,119 A * 1/2000 Starling et al. ..... 345/82
6,034,479 A * 3/2000 Xia ..... 315/169.1
6,057,678 A * 5/2000 Tagiri et al. ..... 324/96
6,118,613 A * 9/2000 Kojima ..... 360/75
6,147,665 A * 11/2000 Friedman ..... 345/75.2
6,195,076 B1 * 2/2001 Sakuragai et al. ..... 345/74.1
6,359,604 B1 * 3/2002 Zimlich ..... 345/74.1
6,518,962 B2 * 2/2003 Kimura et al. ..... 345/211

FOREIGN PATENT DOCUMENTS

JP 3-125205 A 5/1991
JP 8-63247 A 3/1996
JP 9-174918 A 7/1997
JP 9-232074 A 9/1997
JP 11-143429 A 5/1999
JP 2000-293245 A 10/2000

* cited by examiner

*Primary Examiner*—Xiao Wu
*Assistant Examiner*—Abbas Abdulselam
(74) *Attorney, Agent, or Firm*—Morgan, Lewis & Bockius LLP

(57) ABSTRACT

A display apparatus and a driving circuit of a display panel, in which even when an anode line driving circuit is made of a plurality of IC chips, light emission luminance values on the display panel can be uniformed. The display apparatus is made of a plurality of driving circuits having a plurality of light-emission drive current sources each for generating a light-emission drive current to allow a light emitting element of the display panel to emit the light and supplying the light-emission drive current to first electrode lines of the display panel. At least one of the driving circuits is provided with a drive current control circuit for adjusting a current amount of the light-emission drive current to be generated by the driving circuit on the basis of the light-emission drive current generated from the other driving circuit.

7 Claims, 10 Drawing Sheets

DISPLAY APPARATUS AND DRIVING CIRCUIT OF DISPLAY PANEL

BACKGROUND OF THE INVENTION

1. Field of the Invention

The invention relates to a display apparatus using a display panel comprising spontaneous light emitting devices such as organic electroluminescence devices or the like and relates to a driving circuit for the display apparatus.

2. Description of Related Art

An organic electroluminescence (hereinafter, abbreviated to "EL") device is known as a spontaneous light emitting element for realizing a thin display apparatus of a low electric power consumption.

FIG. 1 is a diagram schematically showing the structure of the EL element.

As shown in FIG. 1, the EL element is made in a manner that an organic functional layer 102 of at least one layer comprising an electron transport layer, a light emitting layer, a hole transport layer, and the like and a metal electrode 103 are laminated over a transparent substrate 100 made of a glass plate or the like on which a transparent electrode 101 has been formed.

FIG. 2 is an equivalent circuit diagram electrically showing characteristics of the EL element.

As shown in FIG. 2, the EL element can be represented by a capacitive component C and a component E of diode characteristics which is coupled in parallel with the capacitive component.

When a direct current is applied across the transparent electrode 101 and the metal electrode 103 by applying a plus voltage to an anode of the transparent electrode 101 and applying a minus voltage to a cathode of the metal electrode 103, charges are accumulated in the capacitive component C. When the applied voltage exceeds a barrier voltage or a light emission threshold voltage that is peculiar to the EL element, a current starts flowing from the electrode (on the anode side of the diode component E) into the organic functional layer serving as a light emitting layer, so that the organic functional layer 102 emits light at intensity which is proportional to the current.

FIG. 3 is a diagram schematically showing the structure of an EL display apparatus for displaying an image by using an EL display panel formed by arranging a plurality of EL elements in a matrix shape.

In FIG. 3, cathode lines (metal electrodes) $B_1$ to $B_n$ serving as the first to nth display lines and m anode lines (transparent electrodes) $A_1$ to $A_m$ arranged so as to cross the cathode lines $B_1$ to $B_n$ are formed on an ELDP 10 as an EL display panel. EL elements $E_{11}$ to $E_{nm}$ having the structure as mentioned above are formed at the cross points of the cathode lines $B_1$ to $B_n$ and anode lines $A_1$ to $A_m$, respectively. Each of the EL elements $E_{11}$ to $E_{nm}$ corresponds to one pixel of an ELDP 10.

A light emission control circuit 1 converts supplied image data of one picture plane (n rows, m columns) into pixel data groups $D_{11}$ to $D_{nm}$ corresponding to the respective pixels of the ELDP 10, namely, the EL elements $E_{11}$ to $E_{nm}$ and sequentially supplies those data every row to an anode line driving circuit 2 as shown in FIG. 4.

For example, the pixel data $D_{11}$ to $D_{1m}$ correspond to m data bits for designating whether each of the EL elements $E_{11}$ to $E_{1m}$ belonging to the first display line of the ELDP 10 is allowed to execute the light emission or not. When each data bit is at the logic level "1", it indicates "light emission". When each data bit is at the logic level "0", it indicates "non-light emission".

The light emission control circuit 1 supplies a scanning line selection control signal for sequentially scanning each of the first to nth display lines of the ELDP 10 to a cathode line scanning circuit 3 synchronously with supplying timings of the pixel data of one row as shown in FIG. 4.

The anode line driving circuit 2 first extracts all of the data bits at the logic level "1" designating "light emission" from the m data bits in the pixel data groups. The anode line driving circuit 2 subsequently selects all of the anode lines belonging to the "column" corresponding to each of the extracted data bits from the anode lines $A_1$ to $A_m$, connects a constant current source only to the selected anode lines, and supplies a predetermined pixel drive current i.

The cathode line scanning circuit 3 alternatively selects the cathode line corresponding to the display line shown by the scanning line selection control signal from the cathode lines $B_1$ to $B_n$, sets the selected cathode line to a ground potential, and applies a predetermined high potential $V_{cc}$ to each of the other cathode lines. The high potential $V_{cc}$ is set to almost the same value as that of the voltage across the EL element (voltage which is determined on the basis of a charge amount into the parasitic capacitor C) at the time when the EL element emits the light at a desired luminance.

The anode line driving circuit 2 allows the light-emission drive current to flow between the "column" to which the constant current source is connected and the display line set to the ground potential by the cathode line scanning circuit 3. The EL element formed so as to cross the display line and the "column" emits the light in accordance with the light-emission drive current. Since no current flows between the display line set to the high potential $V_{cc}$ by the cathode line scanning circuit 3 and the "column" to which the constant current source is connected, the EL element arranged to cross the display line and the "column" is maintained in the "non-light emission" state.

When the operation as mentioned above is executed on the basis of the pixel data groups $D_{11}$ to $D_{1m}$, $D_{21}$ to $D_{2m}$, . . . , and $D_{n1}$ to $D_{nm}$, a light emission pattern of one field according to the supplied image data, namely, an image is displayed on the screen of the ELDP 10.

In recent years, to realize a large screen size of the display panel, it is necessary to increase the number of display lines, namely, the number of cathode lines B and increase the number of anode lines A, thereby realizing a highly fine screen. Since a circuit scale of each of the anode line driving circuit 2 and cathode line scanning circuit 3 also enlarges due to an increase in number of anode lines A and number of cathode lines B, therefore, there is a fear of deterioration of the yield in association with an increase in chip area when both of those circuits 2 and 3 are formed in one IC. To avoid it, there is an idea of constructing each of the anode line driving circuit 2 and cathode line scanning circuit 3 by a plurality of IC chips.

If the anode line driving circuit 2 is made of a plurality of IC chips, there however can be a case that the current amounts of light-emission drive currents to be supplied to the anode lines differ among the IC chips due to a variation occurred in the manufacturing process, or the like. Consequently, there is a problem that regions of difference luminance values are formed on the screen of the ELDP 10 due to the difference of the light-emission drive currents.

OBJECTS AND SUMMARY OF THE INVENTION

The invention has been made to solve the problems and it is an object of the invention to provide a display apparatus and a driving circuit of a display panel, in which even when an anode line driving circuit is made of a plurality of IC chips, light emission luminance values on the display panel can be uniformed.

According to the invention, there is provided a display apparatus comprising: a display panel made by forming a light emitting element as one pixel in each cross portion of a plurality of first electrode lines and a plurality of second electrode lines arranged so as to cross each of the first electrode lines; and a driving unit for performing light-emission driving of the display panel, wherein the driving unit is made of a plurality of driving circuits having a plurality of light-emission drive current sources each for generating a light-emission drive current to allow the light emitting device to emit the light and supplying the light-emission drive current to the first electrode line, and at least one of the plurality of driving circuits is provided with a drive current control circuit for adjusting a current amount of the light-emission drive current to be generated by the one driving circuit based on the light-emission drive current generated by the other driving circuit.

According to the invention, there is provided a driving circuit of a display panel, for performing light-emission driving of the display panel made by forming a light emitting device serving as one pixel in each cross portion of a plurality of first electrode lines and a plurality of second electrode lines arranged so as to cross each of the first electrode lines, wherein the driving circuit comprises: a light-emission drive current source for generating a light-emission drive current to allow the light emitting device to emit the light and supplying the light-emission drive current to a partial electrode group in each of the first electrode lines; a drive current control circuit for adjusting a current amount of the light-emission drive current on the basis of an input control current; and a control current output circuit for generating a control current of the same current amount as that of the light-emission drive current and supplying the control current.

DETAILED DESCRIPTION OF THE PREFERRED EMBODIMENTS

An embodiment of the invention will now be described in detail hereinbelow with reference to the drawings.

Figure 5:
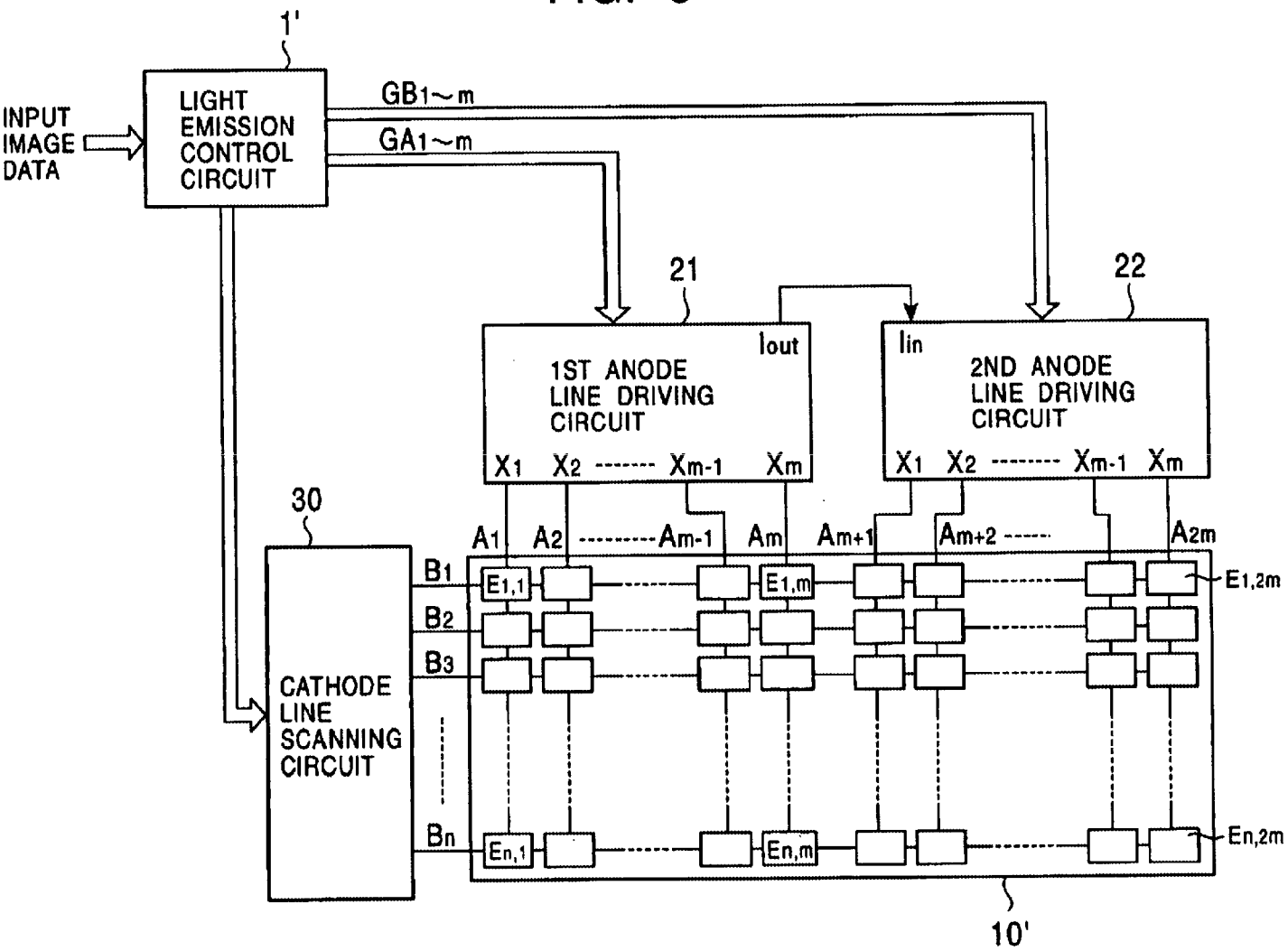
FIG. 5 is a diagram schematically showing the structure of an EL display apparatus according to the invention.

FIG. 5 is a diagram showing a schematic construction of an EL display apparatus according to the invention.

Figure 1:
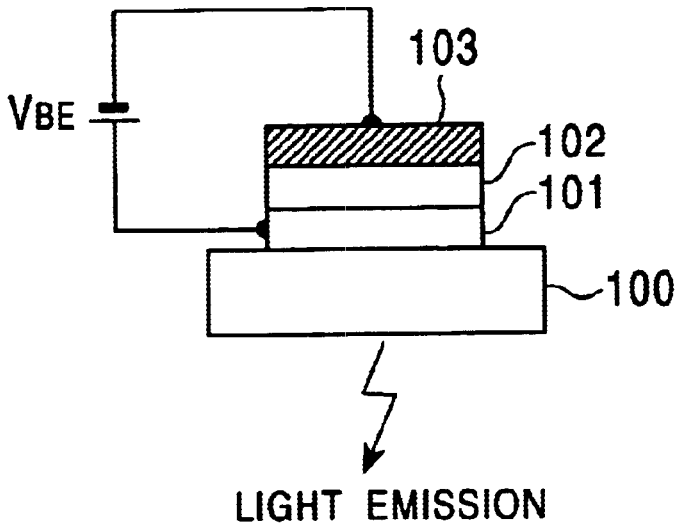
FIG. 1 is a cross-sectional view of an organic electroluminescence device.
Figure 2:
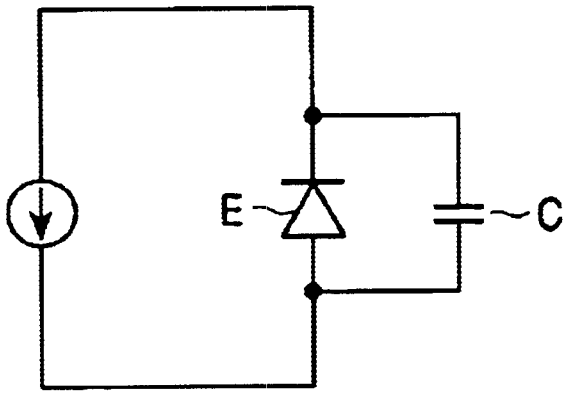
FIG. 2 is a diagram showing an equivalent circuit of the organic electroluminescence device.
Figure 3:
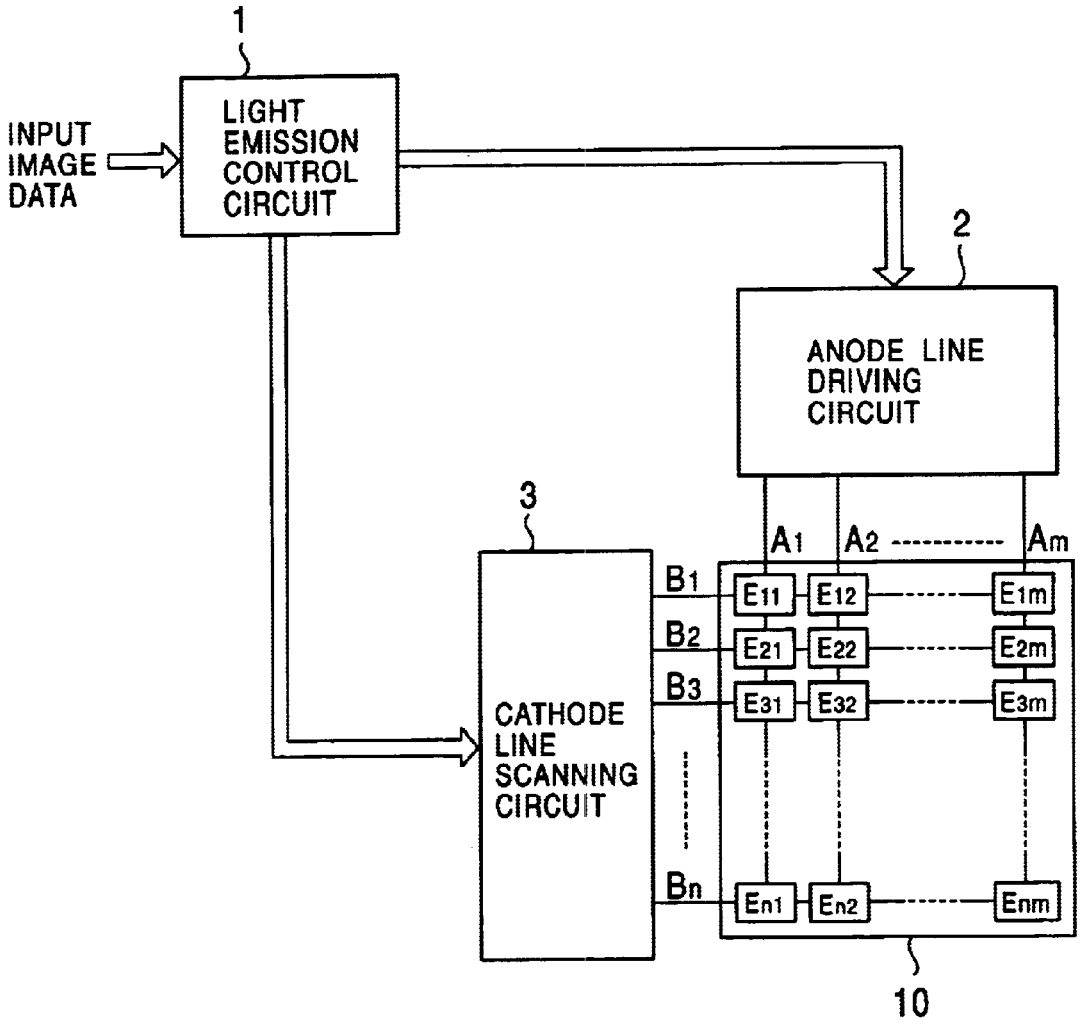
FIG. 3 is a diagram schematically showing the structure of an EL display apparatus.
Figure 4:
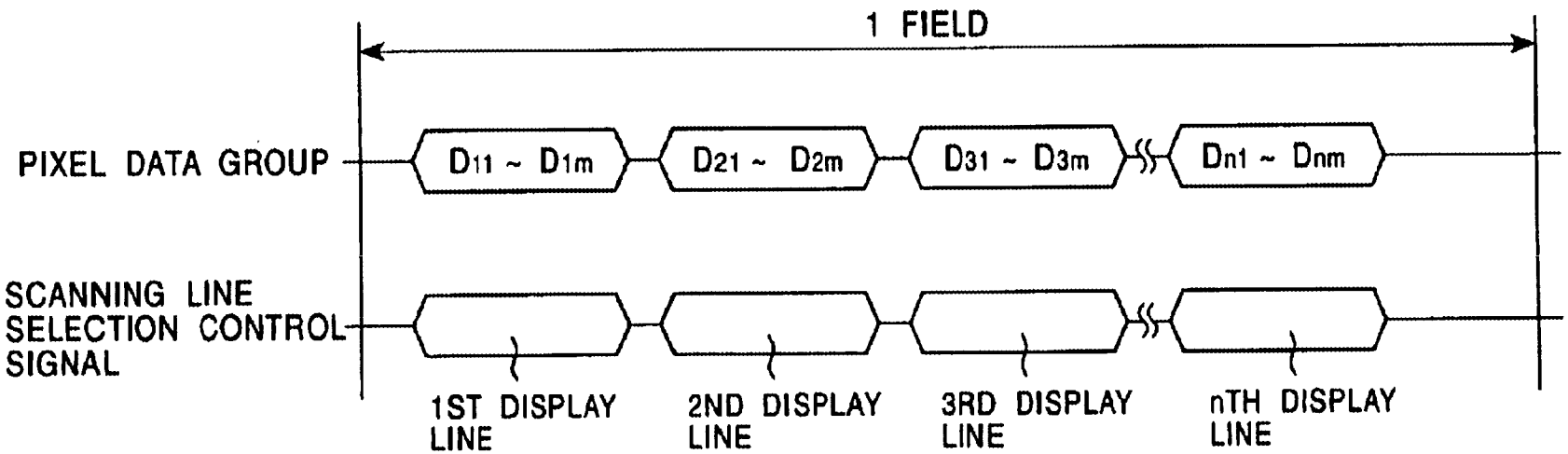
FIG. 4 is a diagram showing supplying timings of pixel data and a scanning line selection control signal by a light emission control circuit 1.

In FIG. 5, cathode lines (metal electrodes) $B_1$ to $B_n$ serving as the first to nth display lines and 2m anode lines (transparent electrodes) $A_1$ to $A_{2m}$ arranged so as to cross the cathode lines $B_1$ to $B_n$ are formed on an ELDP 10' as an EL display panel. EL elements $E_{1,1}$ to $E_{n,2m}$ having the structure as shown in FIG. 1 are formed in the cross portions of the cathode lines $B_1$ to $B_n$ and anode lines $A_1$ to $A_{2m}$, respectively. Each of the EL elements $E_{1,1}$ to $E_{n,2m}$ corresponds to one pixel as an ELDP 10'.

Figure 6:
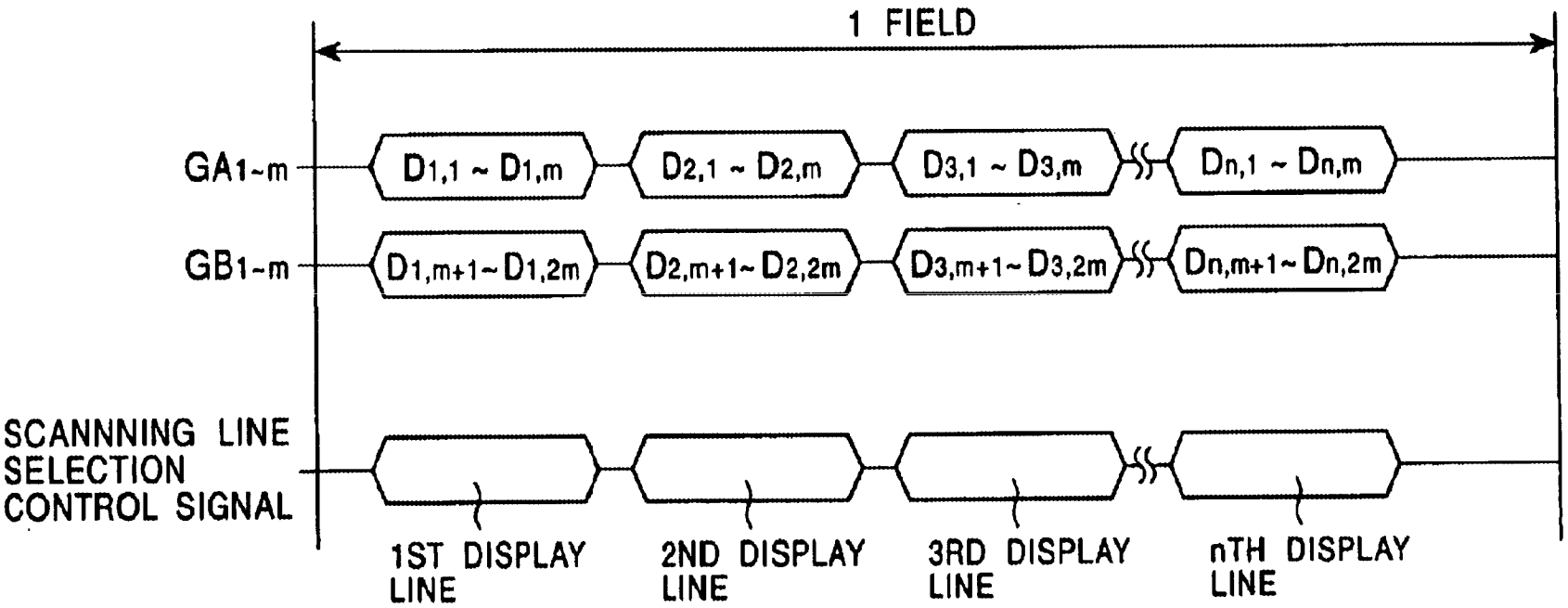
FIG. 6 is a diagram showing supplying timings of pixel data and a scanning line selection control signal by a light emission control circuit 1'.

A light emission control circuit 1' supplies a scanning line selection control signal for sequentially scanning the first to nth display lines of the ELDP 10' to a cathode line scanning circuit 30 as shown in FIG. 6.

The cathode line scanning circuit 30 alternatively selects the cathode line corresponding to the display line shown by the scanning line selection control signal from the cathode lines $B_1$ to $B_n$ of the ELDP 10', sets the selected cathode line to a ground potential, and applies the predetermined high potential $V_{cc}$ to each of the other cathode lines.

The light emission control circuit 1' converts supplied image data of one picture plane (n rows, 2m columns) into the pixel data $D_{1,1}$ to $D_{n,2m}$ corresponding to the respective pixels of the ELDP 10', namely, the EL elements $E_{1,1}$ to $E_{n,2m}$ and divides the pixel data into the pixel data belonging to the first to mth columns and the pixel data belonging to the (m+1)th to 2mth columns. At this time, each of the pixel data $D_{1,1}$ to $D_{1,m}$, $D_{2,1}$ to $D_{2,m}$, $D_{3,1}$ to $D_{3,m}$, . . . , and $D_{n,1}$ to $D_{n,m}$ obtained by grouping the pixel data belonging to the first to mth columns every display line is sequentially supplied to a first anode line driving circuit 21 as first drive data $GA_{1-m}$ as shown in FIG. 6. At the same time, the light emission control circuit 1' sequentially supplies each of the pixel data $D_{1,m+1}$ to $D_{1,2m}$, $D_{2,m+1}$ to $D_{2,2m}$, $D_{3,m+1}$ to $D_{3,2m}$, . . . , and $D_{n,m+1}$ to $D_{n,2m}$ obtained by grouping the pixel data belonging to the (m+1)th to 2mth columns every display line to a second anode line driving circuit 22 as second drive data $GB_{1-m}$ as shown in FIG. 6. As shown in FIG. 6, the first drive data $GA_{1-m}$ and second drive data $GB_{1-m}$ are sequentially supplied to the first anode line driving circuit 21 and second anode line driving circuit 22 synchronously with the scanning line selection control signal. The first drive data group $GA_{1-m}$ corresponds to m data bits for designating whether each of the m EL elements belonging to each of the first to mth columns of each display line of the ELDP 10' is allowed to execute the light emission or not. The second drive data group $GB_{1-m}$ corresponds to m data bits for designating whether each of the m EL elements belonging to each of the (m+1)th to 2mth columns of each display line of the ELDP 10' is allowed to execute the light emission or not. For example, when each data bit is at the logic level "1", the light emission is executed. When each data bit is at the logic level "0", the light emission is not executed.

Figure 7:
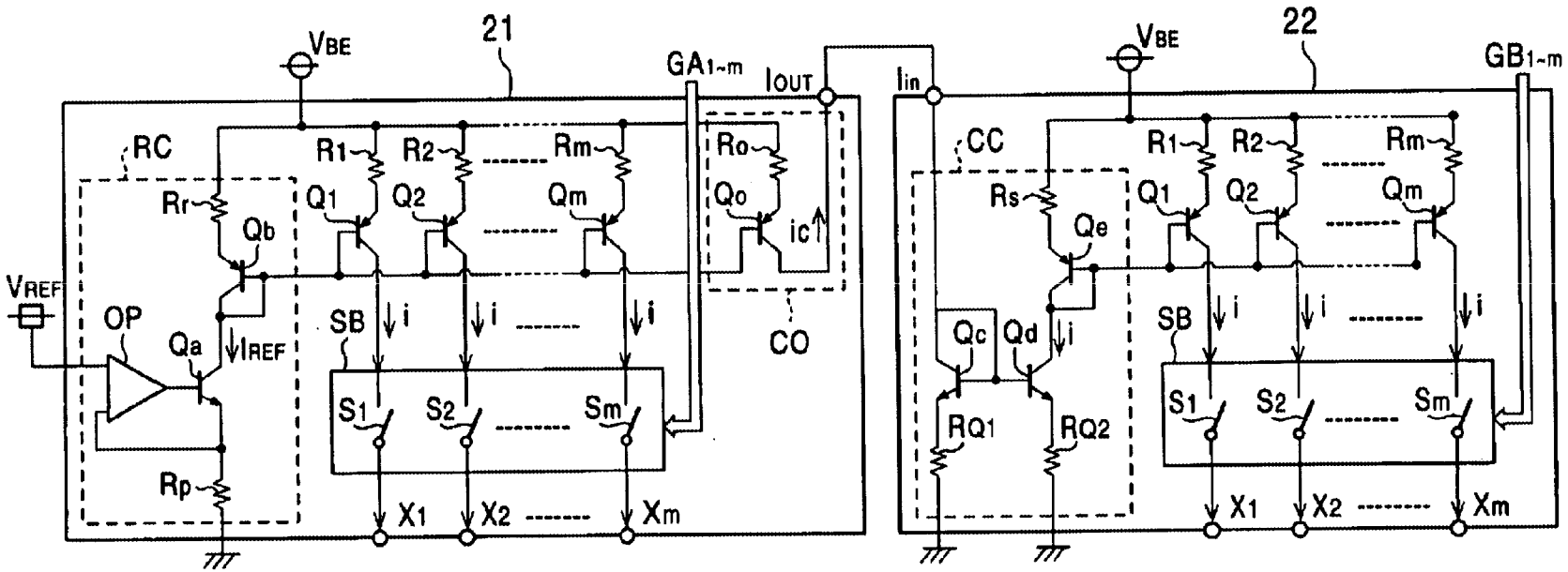
FIG. 7 is a diagram showing an internal construction of a first anode line driving circuit 21 and a second anode line driving circuit 22 as a driving circuit according to the invention.

FIG. 7 is a diagram showing an internal construction of each of the first anode line driving circuit 21 and second anode line driving circuit 22 as a driving circuit according to the invention. Each of the first anode line driving circuit 21 and second anode line driving circuit 22 is formed in two different IC chips.

In FIG. 7, the first anode line driving circuit 21 comprises: a reference current control circuit RC; a control current output circuit CO; a switch block SB; and transistors $Q_1$ to $Q_m$ serving as m current driving sources and resistors $R_1$ to $R_m$.

A predetermined voltage $V_{BE}$ is connected to an emitter of a transistor $Q_b$ in the reference current control circuit RC via a resistor $R_r$. A collector of a transistor $Q_a$ is connected to a base and a collector of the transistor $Q_b$. A predetermined referential potential $V_{REF}$ and an emitter potential of the transistor $Q_a$ are applied to an operational amplifier OP. An output potential of the operational amplifier Op is applied to a base of the transistor $Q_a$. An emitter of the transistor $Q_a$ is connected to the ground potential via a resistor $R_P$. By the above construction, a reference current $I_{REF}$ ($=V_{REF}/R_P$) flows between the collector and emitter of the transistor $Q_a$.

The pixel driving potential $V_{BE}$ is applied to an emitter of each of the transistors $Q_1$ to $Q_m$ via each of the resistors $R_1$ to $R_m$. The base of the transistor $Q_b$ is further connected to a base of each of the transistors $Q_1$ to $Q_m$. In this instance, resistance values of the resistors $R_r$ and $R_1$ to $R_m$ are equal and, further, the transistors $Q_1$ to $Q_m$, $Q_a$, and $Q_b$ have the same characteristics. The reference current control circuit RC and the transistors $Q_1$ to $Q_m$, therefore, construct a current mirror circuit and the light-emission drive current i having the same current value as that of the reference current $I_{REF}$ flows between the emitter and collector of each of the transistors $Q_1$ to $Q_m$ and is generated.

The switch block SB has m switching devices $S_1$ to $S_m$ for deriving the light-emission drive current i generated from each of the transistors $Q_1$ to $Q_m$ to each of output terminals $X_1$ to $X_m$. In this instance, in the switch block SB of the first anode line driving circuit 21, each of the switching devices $S_1$ to $S_m$ is independently on/off controlled in accordance with the logic level of each of the first drive data $GA_1$ to $GA_m$ supplied from the light emission control circuit 1'. For example, when the first drive data $GA_1$ is at the logic level "0", the switching device $S_1$ is turned off. When the first drive data $GA_1$ is at the logic level "1", the switching device $S_1$ is turned on, thereby allowing the light-emission drive current i generated from the transistor $Q_1$ to be supplied to the output terminal $X_1$. When the first drive data $GA_m$ is at the logic level "0", the switching device $S_m$ is turned off. When the first drive data $GA_m$ is at the logic level "1", the switching device $S_m$ is turned on, thereby allowing the light-emission drive current i generated from the transistor $Q_m$ to be supplied to the output terminal $X_m$. As mentioned above, the light-emission drive current i generated from each of the transistors $Q_1$ to $Q_m$ is supplied to each of the anode lines $A_1$ to $A_m$ of the ELDP 10' via each of the output terminals $X_1$ to $X_m$ as shown in FIG. 5.

The pixel driving potential $V_{BE}$ is applied to an emitter of a transistor $Q_0$ in the control current output circuit CO via a resistor $R_0$. The base of the transistor $Q_b$ in the reference current control circuit RC is connected to a base of the transistor $Q_0$. In this instance, a resistance value of the resistor $R_0$ is the same as that of the resistor $R_r$ in the reference current control circuit RC. Further, the transistor $Q_0$ has the same characteristics as those of each of the transistors $Q_a$ and $Q_b$ in the reference current control circuit RC. The transistor $Q_0$ in the control current output circuit CO and the reference current control circuit RC, therefore, construct a current mirror circuit and the current having the same current value as that of the reference current $I_{REF}$ flows between the emitter and collector of the transistor $Q_0$. The control current output circuit CO sets this current to a control current ic and supplies it to an input terminal $I_{in}$ of the second anode line driving circuit 22 via an output terminal $I_{out}$. That is, the same current as the light-emission drive current i which is supplied by the first anode line driving circuit 21 to each of the anode lines $A_1$ to $A_m$ of the ELDP 10' is supplied as a control current ic to the second anode line driving circuit 22.

The second anode line driving circuit 22 comprises: a drive current control circuit CC; the switch block SB; and the transistors $Q_1$ to $Q_m$ serving as m current driving sources and resistors $R_1$ to $R_m$.

A collector and a base of a transistor $Q_c$ in the drive current control circuit CC are connected to the input terminal $I_{in}$ and an emitter is connected to the ground potential via a resistor $R_{Q1}$. The control current ic generated from the first anode line driving circuit 21, therefore, flows between the collector and emitter of the transistor $Q_c$ via the input terminal $I_{in}$. The pixel driving potential $V_{BE}$ is applied to an emitter of a transistor $Q_e$ in the drive current control circuit CC via a resistor $R_S$. A collector of a transistor $Q_d$ is connected to a base and a collector of the transistor $Q_e$. A base of the transistor $Q_d$ is connected to each of the collector and base of the transistor $Q_c$, respectively. An emitter of the transistor $Q_d$ is connected to the ground potential via a resistor $R_{Q2}$, thereby forming a current mirror circuit. A current the same as the control current ic supplied from the first anode line driving circuit 21 flows between the collector and emitter of the transistor $Q_d$.

The accuracy of the current mirror circuit can be increased by inserting a resistor across the terminals $I_{out}$ and $I_{in}$ so that the electric potential between the emitter and the collector of the transistors $Q_0$ equals the electric potential between the emitter and the corrector of each of the transistors $Q_1$ to $Q_m$.

The pixel driving potential $V_{BE}$ is applied to an emitter of each of the transistors $Q_1$ to $Q_m$ in the second anode line driving circuit 22 via each of the resistors $R_1$ to $R_m$. Further, the base of the transistor $Q_e$ is connected to the base of each of the transistors $Q_1$ to $Q_m$ The drive current control circuit CC and the transistors $Q_1$ to $Q_m$, therefore, construct a current mirror circuit and the light-emission drive current i having the same current amount as that of the control current ic supplied from the first anode line driving circuit 21 flows between the emitter and collector of each of the transistors $Q_1$ to $Q_m$ and generated. That is, the drive current control circuit CC adjusts the light-emission drive current i that is generated from each of the transistors $Q_1$ to $Q_m$ of the second anode line driving circuit 22 so as to have the same current amount as that of the light-emission drive current generated from the first anode line driving circuit 21.

The switch block SB has m switching devices $S_1$ to $S_m$ for deriving the light-emission drive current i generated from each of the transistors $Q_1$ to $Q_m$ to each of output terminals $X_1$ to $X_m$. In this instance, in the switch block SB of the second anode line driving circuit 22, each of the switching devices $S_1$ to $S_m$ is independently on/off controlled in accordance with the logic level of each of the second drive data $GB_1$ to $GB_m$ supplied from the light emission control circuit 1'. For example, when the second drive data $GB_1$ is at the logic level "0", the switching device $S_1$ is turned off. When the second drive data $GB_1$ is at the logic level "1", the switching device $S_1$ is turned on, thereby allowing the light-emission drive current i supplied from the transistor $Q_1$ to be supplied to the output terminal $X_1$. When the second drive data $GB_m$ is at the logic level "0", the switching device $S_m$ is turned off. When the second drive data $GB_m$ is at the logic level "1", the switching device $S_m$ is turned on, thereby allowing the light-emission drive current i generated from the transistor $Q_m$ to be supplied to the output terminal $X_m$. As mentioned above, the light-emission drive current i generated from each of the transistors $Q_1$ to $Q_m$ of the second anode line driving circuit 22 is supplied to each of the anode lines $A_{m+1}$ to $A_{2m}$ of the ELDP 10' via each of the output terminals $X_1$ to $X_m$ as shown in FIG. 5.

As mentioned above, the invention has such a construction that besides the current sources (transistors $Q_1$ to $Q_m$) for generating the light-emission drive current, the drive current control circuit CC for maintaining the light-emission drive current to the current amount according to the supplied control current and the control current output circuit CO for generating the light-emission drive current itself as a control current are provided in the anode line driving circuits. When the anode lines of the display panel are shared and driven by a plurality of anode line driving circuits formed in the individual IC chips, the second anode line driving circuit controls the current amount of the light-emission drive current to be generated on the basis of the light-emission drive current which was actually generated by the first anode line driving circuit. Even if there is a variation of the characteristics between the IC chips (as anode line driving circuits), therefore, since the current amounts of the light-emission drive currents which are generated from those anode line driving circuits are almost equal, the uniform light emission luminance can be obtained on the display panel.

In the embodiment, although the anode lines $A_1$ to $A_{2m}$ of the ELDP 10' are driven by the two anode line driving circuits (the first anode line driving circuit 21 and second anode line driving circuit 22), they can be also driven by a plurality of (three or more) anode line driving circuits.

Figure 8:
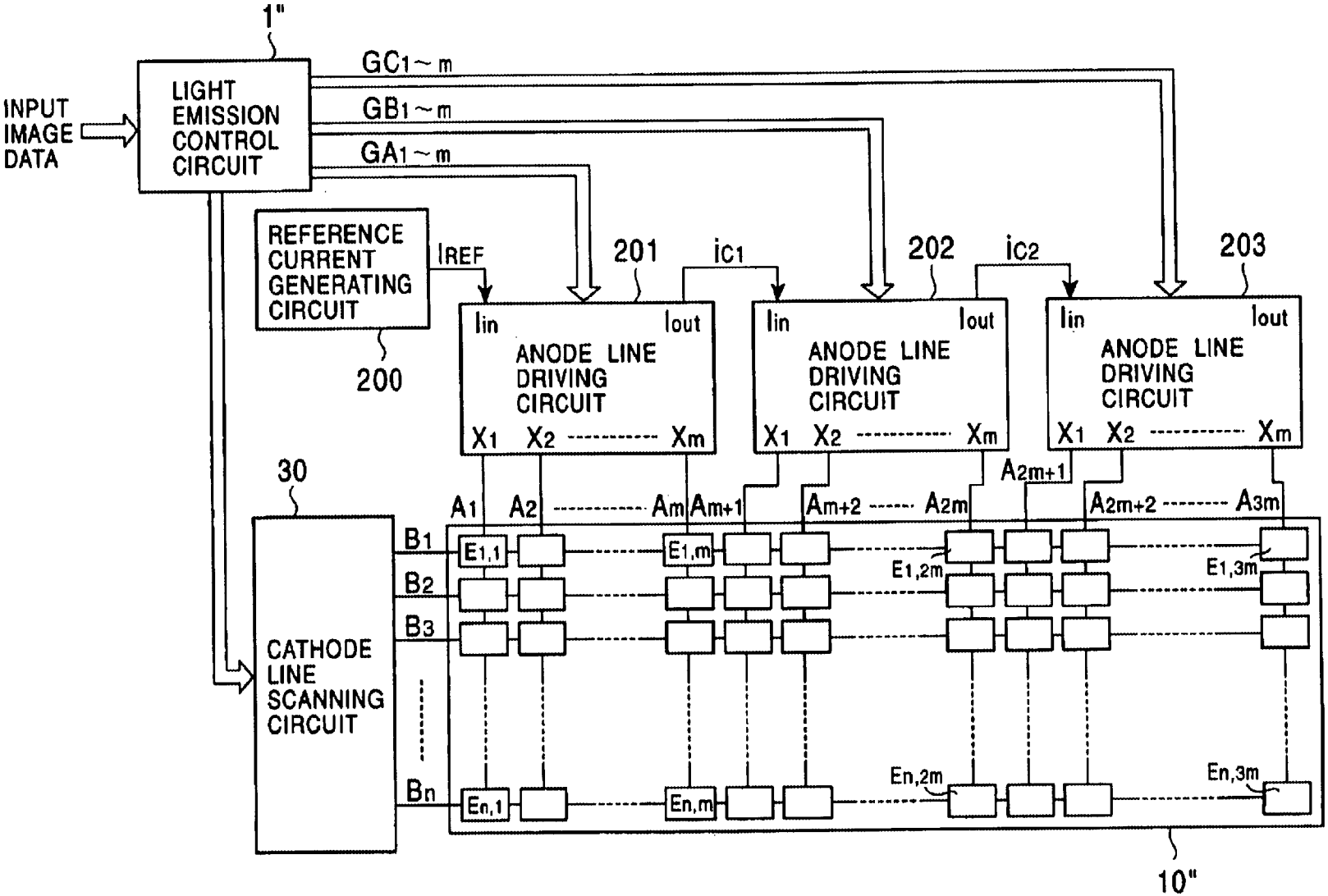
FIG. 8 is a diagram schematically showing the structure of an EL display apparatus in another embodiment of the invention.

FIG. 8 is a diagram showing another example of the structure of the EL display apparatus according to the invention designed in consideration of the above points.

In FIG. 8, cathode lines (metal electrodes) $B_1$ to $B_n$ serving as the first to nth display lines and 3m anode lines (transparent electrodes) $A_1$ to $A_{3m}$ arranged so as to cross the cathode lines $B_1$ to $B_n$ are formed on an ELDP 10" as an EL display panel. EL elements $E_{1,1}$ to $E_{n,3m}$ having the structure as shown in FIG. 1 are formed in the cross portions of the cathode lines $B_1$ to $B_n$ and anode lines $A_1$ to $A_{3m}$, respectively. Each of the EL elements $E_{1,1}$ to $E_{n,3m}$ corresponds to one pixel of an ELDP 10".

Figure 9:
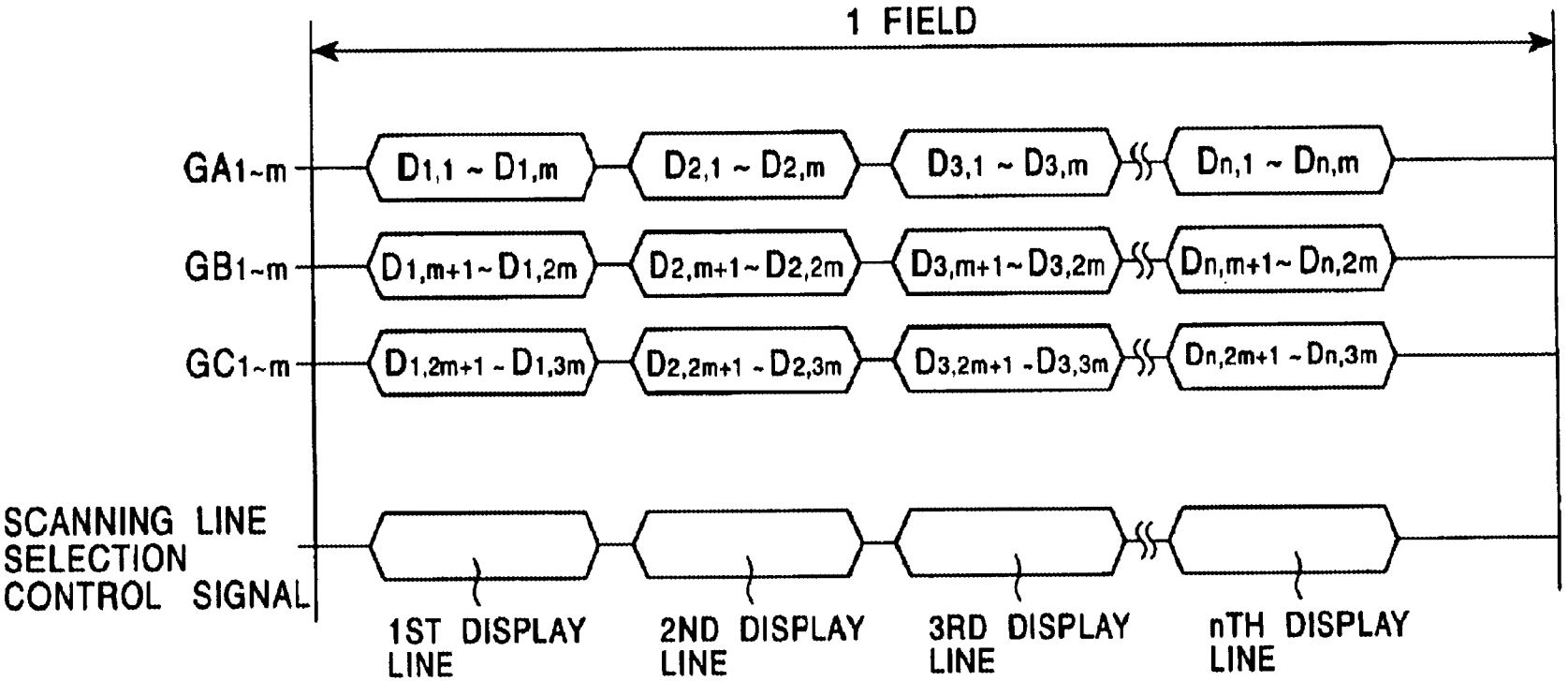
FIG. 9 is a diagram showing supplying timings of pixel data and a scanning line selection control signal by a light emission control circuit 1"

As shown in FIG. 9, a light emission control circuit 1" supplies a scanning line selection control signal for sequentially scanning each of the first to nth display lines of the ELDP 10" to the cathode line scanning circuit 30.

The cathode line scanning circuit 30 alternatively selects the cathode line corresponding to the display line shown by the scanning line selection control signal from the cathode lines $B_1$ to $B_n$ of the ELDP 10", sets the selected cathode line to a ground potential, and applies the predetermined high potential $V_{cc}$ to each of the other cathode lines.

The light emission control circuit 1" converts supplied image data of one picture plane (n rows, 3m columns) into the pixel data $D_{1,1}$ to $D_{n,3m}$ corresponding to the respective pixels of the ELDP 10", namely, the EL elements $E_{1,1}$ to $E_{n,3m}$ and divides the pixel data into the pixel data belonging to the first to mth columns, the pixel data belonging to the (m+1)th to 2mth columns, and the pixel data belonging to the (2m+1)th to 3mth columns, respectively. At this time, each of the pixel data $D_{1,1}$ to $D_{1m}$, $D_{2,1}$ to $D_{2,m}$, $D_{3,1}$ to $D_{3,m}$, . . . , and $D_{n,1}$ to $D_{n,m}$ obtained by grouping the pixel data belonging to the first to mth columns every display line is sequentially supplied to an anode line driving circuit 201 as first drive data $GA_{1-m}$ as shown in FIG. 9. Further, the light emission control circuit 1" sequentially supplies each of the pixel data $D_{1,m+1}$ to $D_{1,2m}$, $D_{2,m+1}$ to $D_{2,2m}$, $D_{3,m+1}$ to $D_{3,2m}$, . . . , and $D_{n,m+1}$ to $D_{n,2m}$ obtained by grouping the pixel data belonging to the (m+1)th to 2mth columns every display line to an anode line driving circuit 202 as second drive data $GB_{1-m}$, as shown in FIG. 9. Moreover, the light emission control circuit 1" sequentially supplies each of the pixel data $D_{1,2m+1}$ to $D_{1,3m}$, $D_{2,2m+1}$ to $D_{2,3m}$, $D_{3,2m+1}$ to $D_{3,3m}$, . . . , and $D_{n,2m+1}$ to $D_{n,3m}$ obtained by grouping the pixel data belonging to the (2m+1)th to 3mth columns every display line to an anode line driving circuit 203 as third drive data $GC_{1-m}$, as shown in FIG. 9. The first drive data $GA_{1-m}$, second drive data $GB_{1-m}$, and third drive data $GC_{1-m}$, are sequentially supplied to the anode line driving circuits 201 to 203 synchronously with the scanning line selection control signal as shown in FIG. 9. The first drive data group $GA_{1-m}$ corresponds to m data bits for designating whether each of the m EL elements belonging to each of the first to mth columns of each display line of the ELDP 10" is allowed to execute the light emission or not. The second drive data group $GB_{1-m}$ corresponds to m data bits for designating whether each of the m EL elements belonging to each of the (m+1)th to 2mth columns of each display line of the ELDP 10" is allowed to execute the light emission or not. Further, the third drive data group $GC_{1-m}$ corresponds to m data bits for designating whether each of the m EL elements belonging to each of the (2m+1)th to 3mth columns of each display line of the ELDP 10" is allowed to execute the light emission or not. For example, when each data bit is at the logic level "1", the light emission is executed. When each data bit is at the logic level "0", the light emission is not executed.

A reference current generating circuit 200 generates the reference current $I_{REF}$ serving as a reference of the light-emission drive current to be supplied to each of the anode lines $A_1$ to $A_{3m}$ of the ELDP 10" by each of the anode line driving circuits 201 to 203 and supplies it to the input terminal $I_{in}$ of the anode line driving circuit 201.

Figure 10:
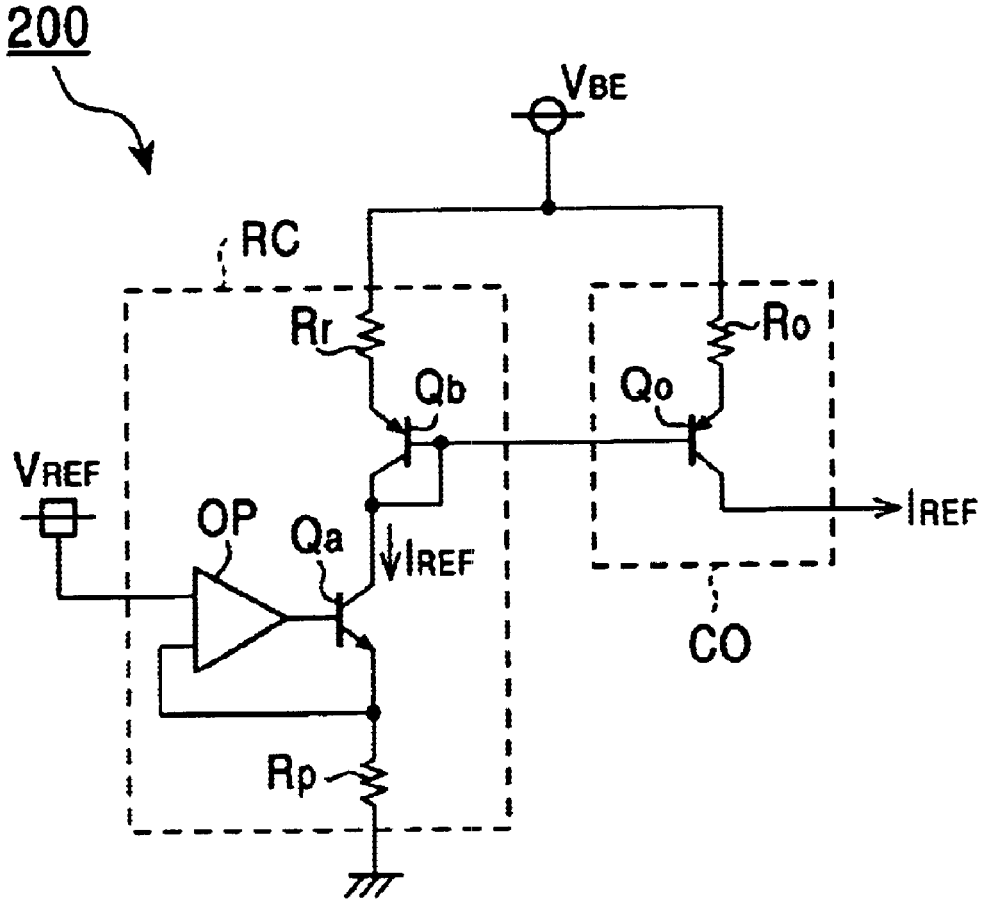
FIG. 10 is a diagram showing an internal structure of a reference current generating circuit 200.

FIG. 10 is a diagram showing an internal construction of the reference current generating circuit 200.

As shown in FIG. 10, the reference current generating circuit 200 is made of the reference current control circuit RC and control current output circuit CO included in the first anode line driving circuit 21 shown in FIG. 7. That is, the reference current $I_{REF}$ that is determined based on the reference potential $V_{REF}$ and resistor $R_P$ is generated by the current mirror circuit comprising the reference current control circuit RC and control current output circuit CO, and the generated reference current $I_{REF}$ is supplied to the input terminal $I_{in}$ of the anode line driving circuit 201.

Figure 11:
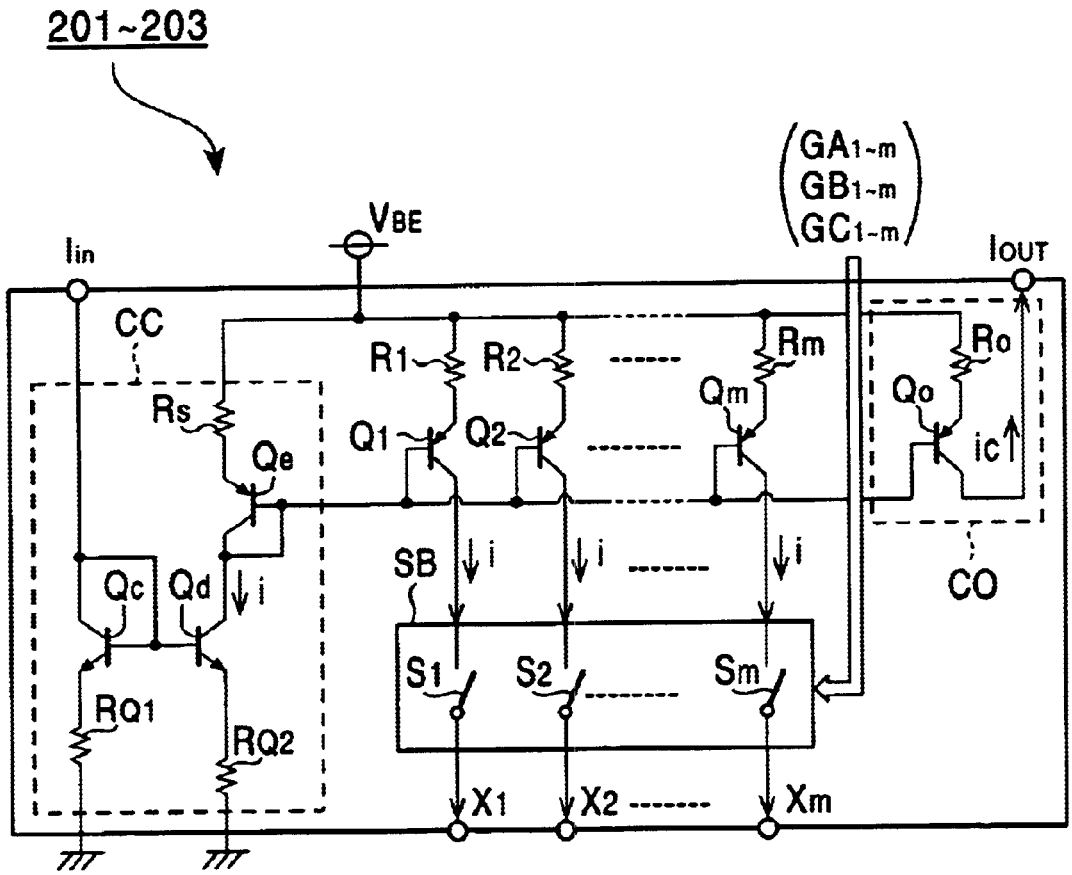
FIG. 11 is a diagram showing an internal structure of each of anode line driving circuits 201 to 203 in another embodiment of the invention.

The anode line driving circuits 201 to 203 have the same internal construction and its internal construction is shown in FIG. 11.

As shown in FIG. 11, each of the anode line driving circuits 201 to 203 comprises the drive current control circuit CC, control current output circuit CO, switch block SB, and transistors $Q_1$ to $Q_m$ serving as m current driving sources and resistors $R_1$ to $R_m$.

The drive current control circuit CC is the same as that installed in the second anode line driving circuit 22 in FIG. 7. The control current output circuit CO is the same as that installed in the first anode line driving circuit 21 in FIG. 7.

Further, a construction comprising the switch block SB and transistors $Q_1$ to $Q_m$ and resistors $R_1$ to $R_m$ is also the same as that shown in FIG. 7.

In brief, the anode line driving circuit as shown in FIG. 11 generates a predetermined current according to the current supplied via the input terminal $I_{in}$ as a light-emission drive current i and generates the current having the same current amount as that of the generated light-emission drive current i as a control current ic from the output terminal $I_{out}$.

The anode line driving circuit 201, therefore, generates m light-emission drive current i each having the same current amount as that of the reference current $I_{REF}$ supplied via the input terminal $I_{in}$ and supplies them to the anode lines $A_1$ to $A_m$ of the ELDP 10" in accordance with the first drive data $GA_{1-m}$, respectively. Further, the anode line driving circuit 201 generates the control current ic having the same current amount as that of the light-emission drive current i and supplies it as a control current ic1 to the input terminal $I_{in}$ of the anode line driving circuit 202 via the output terminal $I_{out}$. The anode line driving circuit 202 generates m light-emission drive current i each having the same current amount as that of the control current ic1 supplied from the input terminal $I_{in}$ and supplies them to the anode lines $A_{m+1}$ to $A_{2m}$ of the ELDP 10" in accordance with the second drive data $GB_{1-m}$, respectively. Further, the anode line driving circuit 202 generates the control current ic having the same current amount as that of the light-emission drive current i and supplies it as a control current ic2 to the input terminal $I_{in}$ of the anode line driving circuit 203 via the output terminal $I_{out}$. The anode line driving circuit 203 generates the m light-emission drive current i each having the same current amount as that of the control current ic2 supplied from the input terminal $I_{in}$ and supplies them to the anode lines $A_{2m+1}$ to $A_{3m}$ of the ELDP 10" in accordance with the third drive data $GC_{1-m}$, respectively.

Although the embodiment has been described by using bipolar type transistors as transistors $Q_1$ to $Q_m$ serving as m light-emission drive current sources, they can be realized by MOS (Metal Oxide Semiconductor) transistors.

As mentioned above, according to the invention, when the anode lines of the display panel are shared and driven by a plurality of anode line driving circuits formed in the individual IC chips, the second anode line driving circuit controls the current amount of the light-emission drive current to be generated on the basis of the light-emission drive current actually generated from the first anode line driving circuit.

Even if there is a variation of the characteristics between the IC chips (as anode line driving circuits), therefore, since the current amounts of the light-emission drive currents which are generated from the IC chips are almost equal, the uniform light emission luminance can be obtained on the display panel.

What is claimed is:

1. A display apparatus comprising:

a display panel made by forming a light emitting device serving as one pixel in each cross portion of a plurality of first electrode lines and a plurality of second electrode lines arranged so as to cross each of said first electrode lines; and a driving unit for light emission driving said display panel, wherein said driving unit is made of a plurality of driving circuits having a plurality of driving transistors each for generating a light-emission drive current to allow said light emitting device to emit light and supplying said light-emission drive current to said first electrode line, at least one of said plurality of driving circuits is further provided with a reference current supplying transistor which generates a light-emission drive current to allow said light emitting device to emit light and supplies said light-emission drive current as a reference current, a first control transistor having a base terminal connected to base terminals respectively of said driving transistor and said reference current supplying transistor, and means for driving said first control transistor so that a current corresponding to a predetermined reference voltage flows through said first control transistor, and another one of said plurality of driving circuits is further provided with a second control transistor having a base terminal connected to the base terminal of said driving transistor, and means for receiving said reference current and for driving said second control transistor so that a current corresponding to said reference current flows through said second control transistor.

2. An apparatus according to claim 1, further comprising a scanning circuit for sequentially applying a ground potential to each of said second electrode lines and applying a predetermined high potential to all of the other second electrode lines to which said ground potential is not applied.

3. An apparatus according to claim 1, wherein each of said light emitting devices is an organic electroluminescence device.

4. An apparatus according to claim 1, wherein each of said driving circuits is formed in each of a plurality of IC chips, respectively.

5. An apparatus according to claim 1, wherein each of said driving circuits is respectively included in a single IC chip.

6. A driving circuit for performing light-emission driving of a display panel made by forming a light emitting element serving as one pixel in each of crossing portions of a plurality of first electrode lines and a plurality of a second electrode lines arranged to cross each of said first electrode lines, said driving circuit comprising:

a plurality of IC chips each having a drive transistor formed therein which generates a light-emission drive current to allow said light emitting device to emit a light and supplies said light-emission drive current to each of said first electrode lines, wherein at least one of said plurality of IC chips is further provided with a reference current supplying transistor which generates a light-emission drive current to allow said light emitting device to emit light and supplies said light-emission drive current as a reference current, a first control transistor having a base terminal connected to base terminals respectively of said driving transistor and said reference current supplying transistor, and means for driving said first control transistor so that a current corresponding to a predetermined reference voltage flows through said first control transistor, and another one of said plurality of IC chips is further provided with a second control transistor having a base terminal connected to the base terminal of said driving transistor, and means for receiving said reference current and for driving said second control transistor so that a current corresponding to said reference current flows through said second control transistor.

7. A display apparatus comprising:

a display panel made by forming a light emitting element serving as one pixel in each of crossing portions of a plurality of first electrode lines and a plurality of second electrode lines arranged to cross each of said first electrode lines; and a driving unit for light emission driving said display panel, wherein said driving unit is made of a plurality of driving circuits each having a driving transistor which generates a light-emission drive current to allow said light emitting device to emit a light and supplies said light-emission drive current to said first electrode lines, and a first reference current generating circuit which generates a current corresponding to a predetermined reference voltage and supplies the generated current as a first reference current, wherein each of said driving circuits is further provided with a reference current supplying transistor which generates a light-emission drive current to allow said light emitting device to emit light and supplies said light-emission drive current as a reference current, a control transistor having a base terminal connected to base terminals respectively of said driving transistor and said reference current supplying transistor, and means for driving said control transistor so that a current corresponding to said first reference current from said first reference current generating circuit or a reference current from another driving circuit flows through said control transistor.

* * * * *